US005125844A

United States Patent [19]

Grant et al.

[11] Patent Number: 5,125,844

[45] Date of Patent: Jun. 30, 1992

[54] PUTTING AND CHIPPING GOLF STROKE APPARATUS

[75] Inventors: Patrick Grant, Lexington; Peter Gazzara, Reading, both of Mass.

[73] Assignee: The Tru-Stroke Company, Woburn, Mass.

[21] Appl. No.: 714,727

[22] Filed: Jun. 13, 1991

[51] Int. Cl.[5] ..... A63B 69/36

[52] U.S. Cl. ..... 434/252; 273/192

[58] Field of Search ..... 273/191 R, 191 A, 191 B, 273/192, 186 A; 434/252

[56] References Cited

U.S. PATENT DOCUMENTS

| | | | |
|---|---|---|---|
| 1,703,403 | 2/1929 | Mesple | 434/252 |
| 2,448,904 | 9/1948 | Millner | 273/191 R |
| 3,073,602 | 1/1963 | Bell | 273/192 X |
| 3,429,571 | 2/1969 | Abel | 273/191 R X |
| 3,591,185 | 7/1971 | Murat | 273/186 |
| 3,730,531 | 5/1973 | Zega | 273/191 A |
| 3,795,399 | 3/1974 | Beckish | 273/191 A |
| 4,949,974 | 8/1990 | Bellagamba | 273/186 R |

*Primary Examiner*—George J. Marlo

*Attorney, Agent, or Firm*—Choate, Hall & Stewart

[57] ABSTRACT

A golfing apparatus for use with a golf club to teach a golfer how to putt or chip a golf ball, the apparatus including a housing, a stroke arm extending outward from the housing, an attachment structure communicating with the stroke arm for rigidly securing the golf club to the stroke arm at or near the head of the golf club, and an actuating device communicating with the stroke arm for moving the stroke arm. In one embodiment, the actuating device includes a motor mounted within the housing on a horizontal gear rack, and a stroke arm attachment assembly connecting the stroke arm to the motor. The stroke arm attachment assembly includes a stroke arm vertical movement device, such as another motor or a bearing. The actuating device moves the stroke farm from an initial position through a predetermined stroke distance so as to teach the golfer gripping the moving golf club a proper putting or chipping golf stroke by the development of muscle memory. Alternatively, the golfer can stand at a distance from the apparatus and observe the moving golf club to learn the proper stroke.

23 Claims, 2 Drawing Sheets

PUTTING AND CHIPPING GOLF STROKE APPARATUS

BACKGROUND OF THE INVENTION

The game of golf requires a golfer to develop substantial skill and consistency in a variety of golf swings. Therefore, several golf swing training devices have been developed over the years to teach golfers how to properly swing their golf clubs to improve their score. Existing golf swing training devices teach a golfer how to properly swing a golf club, such as an iron or wood, by repeatedly swinging the club so that the golfer gripping the iron or wood develops muscle memory for the proper swing. Other golf swing training devices define the proper club stroke by means of a club track and the golfer swings his club within the track to develop muscle memory for the proper golf stroke.

The putting and chipping golf strokes are often the most difficult golf strokes to develop because of the high degree of accuracy that is required. Existing golf swing training devices and practice putting and chipping devices are generally cumbersome or otherwise inadequate for teaching muscle memory for the proper putting and chipping golf strokes. Therefore, it is desirable to develop a putting and chipping golf stroke device which teaches muscle memory for proper putting and chipping strokes.

SUMMARY OF THE INVENTION

The putting and chipping golf stroke apparatus (hereinafter "putting and chipping apparatus") of the invention includes a stroke arm, means for rigidly attaching a putter or chipping iron to the stroke arm, and means for moving the stroke arm. When the putting and chipping apparatus is positioned on a golfing surface and a putter or chipping iron is attached to the stroke arm, the actuated stroke arm moves the putter or chipping iron from an initial position through a predetermined stroke distance so as to teach a golfer gripping the putter or chipping iron how to properly putt or chip a golf ball by developing muscle memory for the proper stroke. Alternatively, the golfer may stand at a distance from the putting and chipping apparatus and observe the moving putter or chipping iron to learn the proper putting or chipping stroke.

The means for moving the stroke arm through the predetermined stroke distance may include a motor movably mounted on a gear rack by at least one gear and a stroke arm attachment assembly securing the stroke arm to the motor. The stroke arm attachment assembly includes means for allowing vertical movement of the stroke arm which may also include a motor.

Another embodiment of the putting and chipping apparatus includes a golf stroke guide having a guide length of a generally arcuate shape defining a maximum putting or chipping golf stroke, a stroke arm disposed within the golf stroke guide, means for attaching a putter or chipping iron to the stroke arm, and means for moving the stroke arm within the golf stroke guide. The stroke arm of this embodiment of the putting and chipping apparatus may move within the golf stroke guide by means of a motorized pulley and belt system, and a stroke arm attachment assembly. The stroke arm attachment assembly is secured to the belt of the pulley and belt system and includes a bearing which allows for the vertical movement of the attached stroke.

The putting and chipping apparatus of the invention may include means for returning the stroke arm to an initial position after the stroke arm is moved through a predetermined putting or chipping golf stroke. Alternatively, the stroke arm may be repeatedly moved without stopping at its initial position. The putting and chipping apparatus may also include means for preselecting a desired putting or chipping golf stroke, means for selectively varying the speed of the stroke arm, means for selectively varying the length and width of the golf stroke guide, means for recording predetermined putting or chipping golf strokes, and means for selecting recorded golf strokes. In addition, the putting and chipping apparatus may include a support foot for providing operational stability, and a weight element or mat, on which the golfer stands, to prevent the apparatus from moving relative to the golfing surface when the stroke arm moves. The stroke arm may be removably secured to the stroke arm attachment assembly and the motor or motors actuating the stroke arm may be reversed to allow both left-handed and right-handed golfers to learn proper putting and chipping golf strokes.

The advantage of the putting and chipping apparatus of the invention is that a golfer develops accurate muscle memory for the proper putting or chipping golf stroke by repeating the proper stroke. The golfer can also learn the proper stroke by watching the putter or chipping iron repeat the proper stroke.

DESCRIPTION OF THE PREFERRED EMBODIMENT

Figure 1:
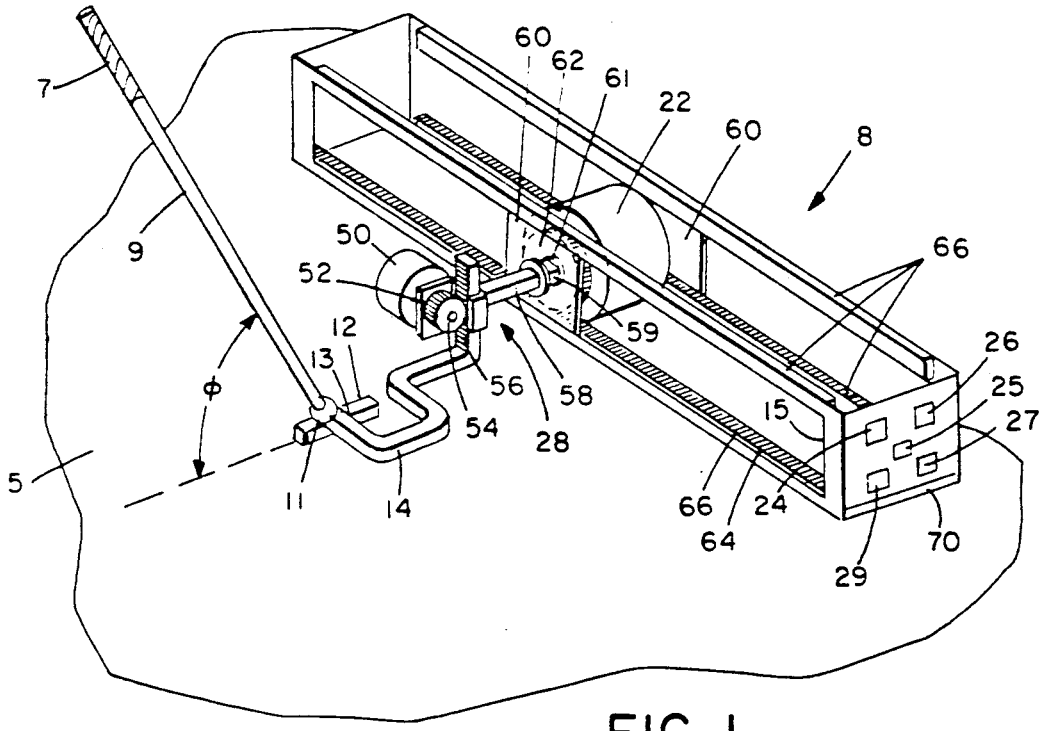
FIG. 1 is a perspective view of the putting and chipping apparatus of the invention with the top section of the apparatus casing removed.

Reference is made to FIG. 1 showing the putting and chipping apparatus 8 of the invention having an apparatus casing 18 positioned on a golfing surface 5 wherein the casing 18 is shown without a top section to more fully disclose the features of the invention. The putting and chipping apparatus 8 includes a front opening 15, a stroke arm 14, clamping means 11 for rigidly securing a putter or chipping iron 9 to the stroke arm 14, and means for moving the stroke arm 14 through a predetermined putting or chipping stroke.

As shown in FIG. 1, the means for moving the stroke arm 14 through a predetermined putting or chipping stroke include a stroke arm attachment assembly 28 and a motor 22. The stroke arm attachment assembly 28 includes a motor 50 mounted on a bracket 52, a gear 54, a gear rack 56 formed in the stroke arm 14 for engaging gear 54, and a stroke arm support 58 attached to the bracket 52 and mounted to a guide plate 60. When motor 50 is actuated by an on/off switch 26, the gear 54 moves up and down on the gear rack 56 causing the stroke arm 14 to move vertically. The rigid attachment of the stroke arm attachment assembly 28 to one of the guide plates 60 may prohibit the putter or chipping iron from moving in a plane parallel to the golfing surface 5 and in a direction perpendicular to the direction of horizontal motion of the stroke arm 14.

Horizontal movement of the stroke arm 14 is provided by the motor 22 attached to guide plates 60 mounted within guide rails 66. The motor 22 includes a gear 62 for engaging the gear rack 64 disposed within the casing 18, and a motor bearing 61. The guide plate 60 is attached to the motor 22 at the motor bearing 61 by connecting rod 59. When the motor 22 is actuated by the on/off switch 26, the gear 62 engages the gear rack 64 causing the motor 22, connecting rod 59, and guide plates 60 move transversely along guide rails 66, thus providing horizontal movement of the stroke arm 14. Motors 50 and 22 are synchronized to produce the proper putting or chipping stroke.

The putter or chipping iron 9 includes a shaft 10, grip 7, and club head 12 having a bottom edge 13. The putter or chipping iron 9 is rigidly secured to the stroke arm 14 by clamping means 11 so that the bottom edge 13 of the club head 12 is generally perpendicular to the direction of horizontal motion of the stroke arm 14. The angle $\phi$ of the club shaft 10 with respect to the golfing surface 5 is selected by the golfer prior to attaching the club 9 to the stroke arm 14. It is noted that the clamping means 11 may secure the putter or chipping iron at more than one location along the shaft 10.

Figure 4:
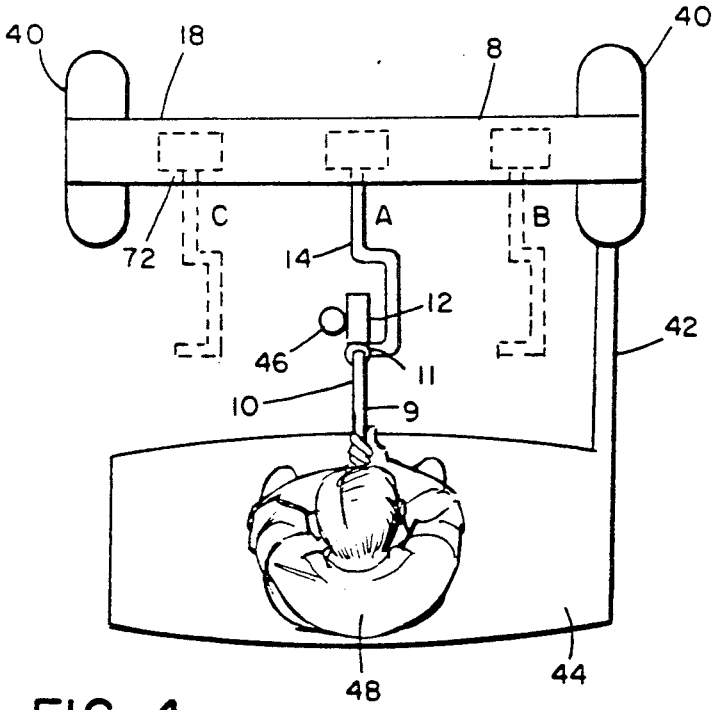
FIG. 4 is a top view of the putting and chipping apparatus of FIG. 2.

When the club 9 is rigidly secured to the stroke arm 14, and the motors 50 and 22 are actuated by the on/off switch 26, the stroke arm 14 is moved within the front opening 15 from an initial position through a predetermined putting or chipping stroke. More specifically, as shown in FIG. 4, the predetermined putting or chipping stroke includes a stroke motion from the initial position A, to a take-back position B, through the initial position A, to a follow-through position C, and back to the initial position A. The stroke arm 14 may be repositioned within the stroke arm attachment assembly 28 and the direction of the motor 22 may be reversed so as to teach left-handed golfers a proper putting or chipping stroke. Therefore, for left-handed golfer's, the take-back position will be at point C and the follow-through position will be at point B.

A golfer gripping the club 9 at the grip 7 learns the proper putting or chipping stroke by developing muscle memory. Alternatively, the golfer learns the proper putting or chipping stroke by standing at a distance from the putting and chipping apparatus 8 and observing the stroke arm 14 and attached club 9 move through the predetermined stroke.

Figure 2:
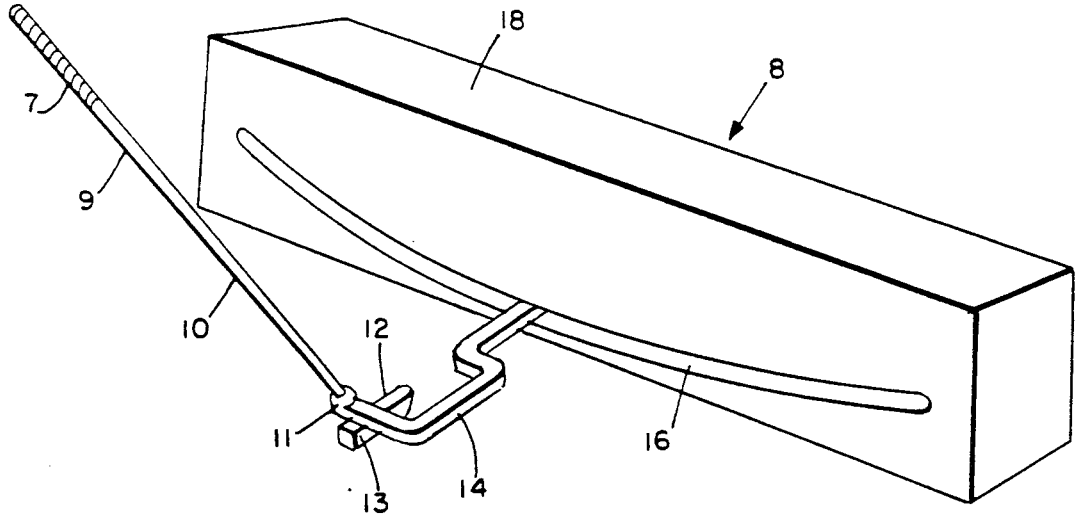
FIG. 2 is a perspective view of another embodiment of the putting and chipping apparatus of the invention.

Another embodiment of the putting and chipping apparatus 8 of the invention is shown in FIG. 2 having an arcuate golf stroke guide 16 defining a maximum putting or chipping stroke, a stroke arm 14 disposed within the golf stroke guide 16, and means for moving the stroke arm 14 within the golf stroke guide 16. The apparatus 8 may also include means (not shown) for varying the length and width of the golf stroke guide 16.

Figure 3:
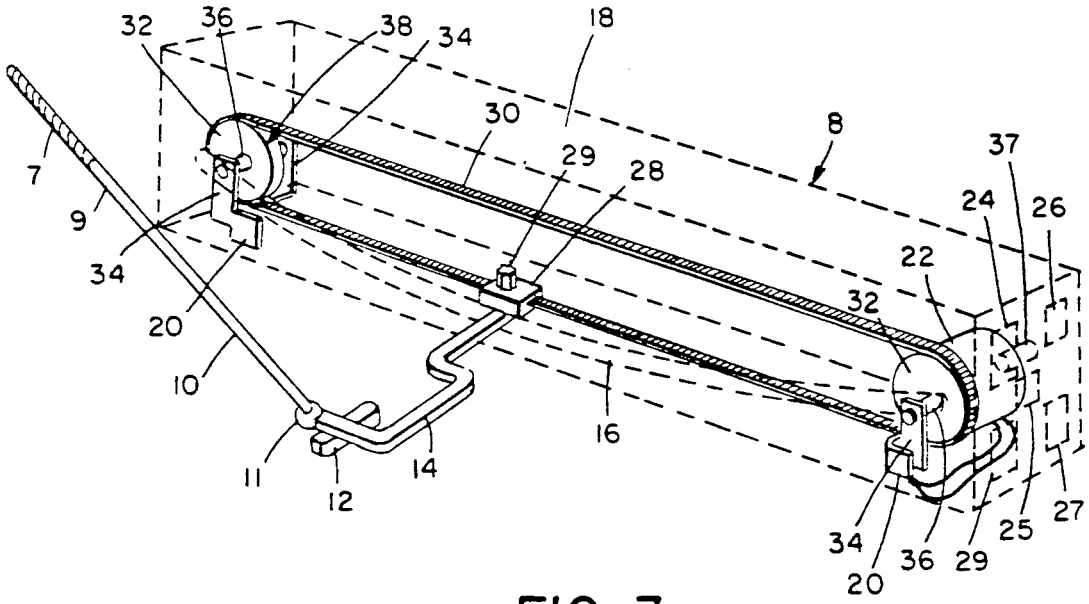
FIG. 3 is a perspective view of the putting and chipping apparatus of the invention, as shown in FIG. 2, with the apparatus casing represented in phantom.

As shown in FIG. 3, the means for moving the stroke arm 14 of this embodiment of the invention through a predetermined putting or chipping stroke include a stroke arm attachment assembly 28 and a pulley and belt system 38. The stroke arm 14 is mounted to a stroke arm attachment assembly 28 via bearing 29 which allows for vertical movement of the stroke arm 14 when the stroke arm 14 is moved within the golf stroke guide 16.

Horizontal movement of the stroke arm 14 is provided by a pulley and belt system 38 including a belt 30, pulleys 32 positioned within the casing 18 at each end of the apparatus 8, and a motor 22 mounted within the casing by shaft 37. The stroke arm attachment assembly 28 is rigidly secured to the belt 30. When the belt 30 is actuated by motor 22 via the on/off switch 26, the stroke arm 14 moves horizontally as the belt 30 passes over the pulleys 32. As shown in FIG. 3, the belt 30 may be a chain and the pulleys 32 may be gears having a plurality of teeth (not shown) for engaging the chain. The belt 30 and pulleys 32 may be made of a plastic or metal material. The pulleys 32 are rotatably mounted on shafts 36 which rotate within brackets 34. When the stroke arm attachment assembly 28 engages microswitches 20 disposed at each end of the guide 16, the motor 22 reverses direction causing the stroke arm 14 to move back and forth within the golf stroke guide 16. The microswitches 20 may be disposed on each side of the stroke arm attachment assembly 28 at various locations along the golf stroke guide 16 so as to control the length of the putting or chipping stroke.

As previously described, a golfer gripping the club 9 at grip 7 develops muscle memory for the proper putting or chipping stroke. The golfer may also learn the proper stroke by observing the moving putter or chipping iron 9.

The putting and chipping apparatus 8 of the invention may also include a control system (not shown) having a stroke selector switch 27 which allows the golfer to select either a putting or chipping stroke, a stroke number selector switch 29 which allows the golfer to select the number of times the stroke will be repeated, and a speed selector switch 24 which allows the golfer to select a desired speed of the stroke arm during a putting or chipping stroke, or to vary the speed of the stroke throughout the stroke. The control system may also include means for recording predetermined putting or chipping strokes such as a computer (not shown), and an initial position selector switch 25 which allows the golfer to select the initial position of the stroke arm 14.

The motors 50 and 22 of FIG. 1, and the motor 22 of FIG. 3 may be direct drive motors supplied by an AC or DC power source (not shown) activated by the on/off switch 26. Alternatively, when the putting and chipping apparatus 8 is designed so as to be portable, the required motors can be powered by batteries (not shown).

FIG. 4 shows a top view of another embodiment of the putting and chipping apparatus 8 of the invention. In this embodiment, the apparatus 8 includes at least one support foot 40 to provide operational stability when the stroke arm 14 is actuated. In addition, a mat 44 is attached to the apparatus 8 by means of a connecting section 42. When the golfer 48 stands on the mat 44, the apparatus 8 is further prevented from moving relative to the golfing surface 5. Alternatively, as shown in FIG. 1, a weight element 70 may be included in the putting and chipping apparatus 8 to prevent the apparatus 8 from moving relative to the golfing surface 5 when the stroke arm 14 is actuated. FIG. 4 also shows that markings 72 may be included on the top portion of the apparatus casing 18 to designate the length of the putting or chipping stroke. The golfer may use the putting and chipping apparatus 8 with or without a golf ball 46 positioned at or near point A, as shown in FIG. 4.

What is claimed is:

1. A golfing apparatus for use with a golf club to teach a golfer how to putt or chip a golf ball, the apparatus including a housing positioned on a golfing surface, a stroke arm extending outward from the housing, an attachment structure communicating with the stroke arm for rigidly securing the golf club to the stroke arm at or near the club head of the golf club, and an actuating device communicating with the stroke arm for moving the stroke arm from an initial position through a predetermined stroke distance so as to teach a golfer gripping or observing the moving golf club how to properly putt of chip a golf ball.

2. The golfing apparatus of claim 1 wherein the actuating device includes a horizontal gear rack mounted within the housing, a motor movably mounted on the gear rack by at least one gear communicating with the motor and the gear rack, and a stroke arm attachment assembly for securing the stroke arm to the motor, the stroke arm attachment assembly including a stroke arm vertical movement device.

3. The golfing apparatus of claim 1 wherein the actuating device includes a pulley and belt system disposed within the housing and actuated by a motor communicating with the pulley and belt system, and a stroke arm attachment assembly securing the stroke arm to the belt of the pulley and belt system, the stroke arm attachment assembly including a stroke arm vertical movement device.

4. The golfing apparatus of claim 2 or 3 wherein the stroke arm vertical movement device includes a vertical gear rack disposed on the stroke arm and a rotating gear engaging the vertical gear rack and actuated by a motor.

5. A golfing apparatus for use with a golf club for teaching a golfer how to putt or chip a golf ball, the apparatus including a housing positioned on a golfing surface, a golf stroke guide communicating with the housing and having a guide length defining a maximum putting or chipping golf stroke, a stroke arm disposed within the golf stroke guide and extending outwardly from the housing, an attachment structure communicating with the stroke arm for rigidly securing the golf club to the stroke arm, and an actuating device communicating with the stroke arm for moving the stroke arm within the golf stroke guide from an initial position through a predetermined stroke distance so as to teach a golfer gripping or observing the moving the golf club how to properly putt or chip a golf ball.

6. The golfing apparatus of claim 5 wherein the golf stroke guide includes a generally arcuate shape, the actuating device includes a pulley and belt system disposed within the housing and actuated by a motor, and a stroke arm attachment assembly securing the stroke arm to the belt of the pulley and belt system, the stroke arm attachment assembly including a stroke arm vertical movement device.

7. The golfing apparatus of claim 6 wherein the stroke arm vertical movement device includes a bearing communicating with an end of the stroke arm.

8. The golfing apparatus of claim 2, 1 or 6 wherein the motor direction is reversible so as to allow left-handed and right-handed golfers to learn a proper putting or chipping golf stroke.

9. The golfing apparatus of claim 1 or 5 wherein the apparatus includes a device for preselecting a desired putting or chipping golf stroke.

10. The golfing apparatus of claim 1 or 5 wherein the apparatus includes a device for returning the stroke arm to an initial position after the stroke arm is moved through a predetermined putting or chipping stroke.

11. The golfing apparatus of claim 1 or 5 wherein the apparatus is portable.

12. The golfing apparatus of claim 1 or 5 wherein the apparatus includes at least one support foot attached to the housing for providing stability to the apparatus when the stroke arm is moved.

13. The golfing apparatus of claim 1 or 5 wherein the apparatus includes a mat rigidly secured to the housing so that when the golfer stands on the mat, the golfing apparatus is prevented from moving relative to the golfing surface when the stroke arm is moved.

14. The golfing apparatus of claim 1 or 5 wherein the apparatus includes a weight element to prevent the apparatus from moving relative to the golfing surface when the stroke arm is moved.

15. The golfing apparatus of claim 1 or 5 wherein the golf club is attachable to the stroke arm at varying golf club shaft angles with respect to the golfing surface so that the bottom edge of the golf club is generally perpendicular to the direction of motion of the stroke arm.

16. The golfing apparatus of claim 1 or 5 wherein the apparatus includes a device for selectively adjusting the speed of the stroke arm of each predetermined stroke or throughout one predetermined stroke.

17. The golfing apparatus of claim 1 or 5 wherein the apparatus includes a device for recording variable predetermined putting or chipping golf strokes, and a device for selecting a recorded predetermined putting or chipping golf stroke.

18. The golfing apparatus of claim 1 or 5 wherein the device for recording variable predetermined putting or chipping golf strokes and selecting said golf strokes includes computer memory.

19. The golfing apparatus of claim 1 or 5 wherein the apparatus includes a device for selecting the initial position of the stroke arm.

20. The golfing apparatus of claim 1 or 5 wherein the stroke arm is removably secured to the stroke arm attachment so that it may be repositioned to allow left-handed and right-handed golfers to learn a proper putting or chipping golf stroke.

21. The golfing apparatus of claim 1 or 5 wherein the apparatus includes a device for preventing the golf club from moving in a plane parallel to the golfing surface and in a direction perpendicular to a horizontal direction of motion of the stroke arm.

22. The golfing apparatus of claim 1 or 5 wherein the apparatus includes a plurality of markings disposed on a top surface of the housing for indicating the length of the predetermined putting or chipping golf stroke.

23. The golfing apparatus of claim 5 wherein the golf stroke guide includes a variable length and a variable width, and the apparatus includes a device for varying the length and width of the golf stroke guide.

* * * * *

UNITED STATES PATENT AND TRADEMARK OFFICE

CERTIFICATE OF CORRECTION

PATENT NO. : 5,125,844

DATED : June 30, 1992

INVENTOR(S) : Patrick Grant and Peter Gazzara

It is certified that error appears in the above—identified patent and that said Letters Patent is hereby corrected as shown below:

In the Abstract, line 15: please delete "farm" and insert therefor -- arm --; and Signed and Sealed this Twenty-sixth Day of October, 1993

*Attest:*

BRUCE LEHMAN

*Attesting Officer*

*Commissioner of Patents and Trademarks*